US007387705B1

(12) United States Patent
Burrows

(10) Patent No.: US 7,387,705 B1
(45) Date of Patent: Jun. 17, 2008

(54) ROLLER CONDITIONING SHEET AND METHOD THEREOF

(76) Inventor: Everitt J. Burrows, 22 Dehart Ave., Hewitt, NJ (US) 07421

( * ) Notice: Subject to any disclaimer, the term of this patent is extended or adjusted under 35 U.S.C. 154(b) by 462 days.

(21) Appl. No.: 11/123,576

(22) Filed: May 6, 2005

(51) Int. Cl.
*D21H 19/22* (2006.01)
*D21H 11/12* (2006.01)

(52) U.S. Cl. ..... 162/164.1; 162/148; 162/158; 134/9

(58) Field of Classification Search ..... 162/148, 162/158, 164.1, 168.1, 169, 173, 179, 183, 162/184, 164.7; 15/104.93; 134/6, 9
See application file for complete search history.

(56) References Cited

U.S. PATENT DOCUMENTS 4,611,361 A * 9/1986 Shinkai ..... 15/104.93
5,589,034 A * 12/1996 Hultman et al. ..... 162/111
7,229,530 B2 * 6/2007 Anderson et al. ..... 162/158

FOREIGN PATENT DOCUMENTS

JP 52-37815 * 3/1977
JP 57-154241 * 9/1982

* cited by examiner

*Primary Examiner*—Eric Hug

(57) ABSTRACT

Roller conditioning sheet and a method for conditioning roller conveyors in an office machine are disclosed. The roller conditioning sheet is impregnated with a liquid conditioning material that contains at least 30 weight percent of tri-ethylene glycol. The liquid conditioning material may further contain at least 20 weight percent of methoxy-ethanol. The roller conditioning sheet of the present invention not only conditions the cover material on roller conveyors, may also serve a cleaning function for the roller conveyors. The roller conditioning sheet is impregnated with a liquid conditioning material and then protected from evaporation by cover sheets such as plastic or wax paper.

12 Claims, 3 Drawing Sheets

ROLLER CONDITIONING SHEET AND METHOD THEREOF

FIELD OF THE INVENTION

The present invention generally relates to an apparatus for maintaining office equipment and more particularly, relates to a roller conditioning sheet for conditioning and cleaning a rubber roller such that the roller regains its flexibility and resiliency.

BACKGROUND OF THE INVENTION

Roller conveyors are widely used in handling sheet stocks in the materials handling industry. Roller conveyors are used for moving sheets from one location to another such that the sheets can be chemically processed, i.e. printing by ink or fixing images by thermal reaction.

In a conventional office environment, roller conveyors are widely used in office machines such as computer printers, fax machines, copy machines, image scanners and various products that combine such uses. For instance, roller conveyors may be included as a part of a series of rollers that are rotatably supported on a rigid frame structure in one of those office machines. Roller conveyors are generally constructed in an elongated cylindrical-shaped body that is rotatably mounted between a pair of frame rails. The cylindrical-shaped roller body may be fixed to a rigid support shaft that extends between the frame rails, and most likely, supported by low-friction bearings mounted in the frame rails. In order to impart the necessary frictional or gripping capability of the roller conveyors, the conveyors are normally provided with a layer of a cover material on the outer surface of the cylindrical-shaped roller body. The layer of the cover material can be provided in rubber, urethane or other flexible and resilient materials in order to avoid damages to the objects being conveyed by the roller conveyor, i.e. such as paper, and moreover, to assist in the frictional movement of the objects by the rollers.

Irrespective of the type of flexible material used in the roller cover, the outermost contact surface of the cover material frequently becomes hardened due to the continuous conveying motion and the continuous contact with the objects conveyed in a hostile environment of high heat and low humidity. As a result, the roller conveyors gradually loose their frictional or gripping capability for transporting objects between the rollers and thus, renders the office machine disabled in performing its function. Instead of replacing the roller conveyors at a high cost, it is desirable to have a method for restoring the cover material on a roller conveyor to its original flexibility and resiliency.

It is therefore an object of the present invention to provide an apparatus and a method for restoring the flexibility and resiliency of a cover material on a roller conveyor.

It is another object of the present invention to provide a roller conditioning sheet and a method for using the sheet for conditioning an aged cover material on a roller conveyor such that its flexibility and resiliency are restored.

It is still another object of the present invention to provide a roller conditioning sheet that conditions and cleans the outermost surface of a cover material on a roller conveyor and a method for conditioning and cleaning a roller.

SUMMARY OF THE INVENTION

The present invention discloses a roller conditioning sheet that has a high rag content, i.e. of at least 20 weight percent, that is impregnated with a liquid material that contains at least 30 weight percent tri-ethylene glycol. The liquid material may further contain at least 20 weight percent of methoxy-ethanol. The liquid material for impregnating the high rag content sheet may further contain at least 10 weight percent of poly-oxy-1-2-ethanediyl, and at least 7 weight percent of alpha-hydro-omega-hydroxy.

In a preferred embodiment, the present invention roller conditioning sheet is provided in a size that is the same as a copier paper, such as 8½ inch by 11 inch. In the preferred embodiment, the liquid material used to impregnate the high rag content sheet may contain between 30 weight percent and 50 weight percent of tri-ethylene glycol; between 20 weight percent and 40 weight percent of methoxy-ethanol; between 10 weight percent and 20 weight percent of poly-oxy-1-2-ethanediyl; and between 7 weight percent and 17 weight percent of alpha-hydro-omega-hydroxy. In a more preferred embodiment, the liquid material for impregnating the high rag content sheet contains 43 weight percent of tri-ethylene glycol; 30 weight percent of methoxy-ethanol; 15 weight percent of poly-oxy-1-2-ethanediyl; and 7 weight percent of alpha-hydro-omega-hydroxy.

The present invention further provides a method for conditioning a roller conveyor that is covered with a flexible and resilient cover material such as rubber or polyurethane. The method can be carried out by first switching on the office machine that contains the roller conveyors, and then feeding through a roller conditioning sheet that is impregnated with a liquid conditioning material through the roller conveyors. Optionally, a clean, dry sheet of high rag content paper may be fed through the roller conveyors after the conditioning step to absorb and remove any excess liquid from the outermost surface of the roller. The method may also include the step of first removing protective cover layers from the upper and lower surfaces of the roller conditioning sheet.

BRIEF DESCRIPTION OF THE DRAWINGS

The invention will now be described, by way of example, with reference to the accompanying drawings, in which.

DETAILED DESCRIPTION OF THE PREFERRED EMBODIMENT

In accordance with the present invention, a roller conditioning sheet and a method for conditioning a roller conveyor covered by a flexible and resilient material are provided.

Figure 1:
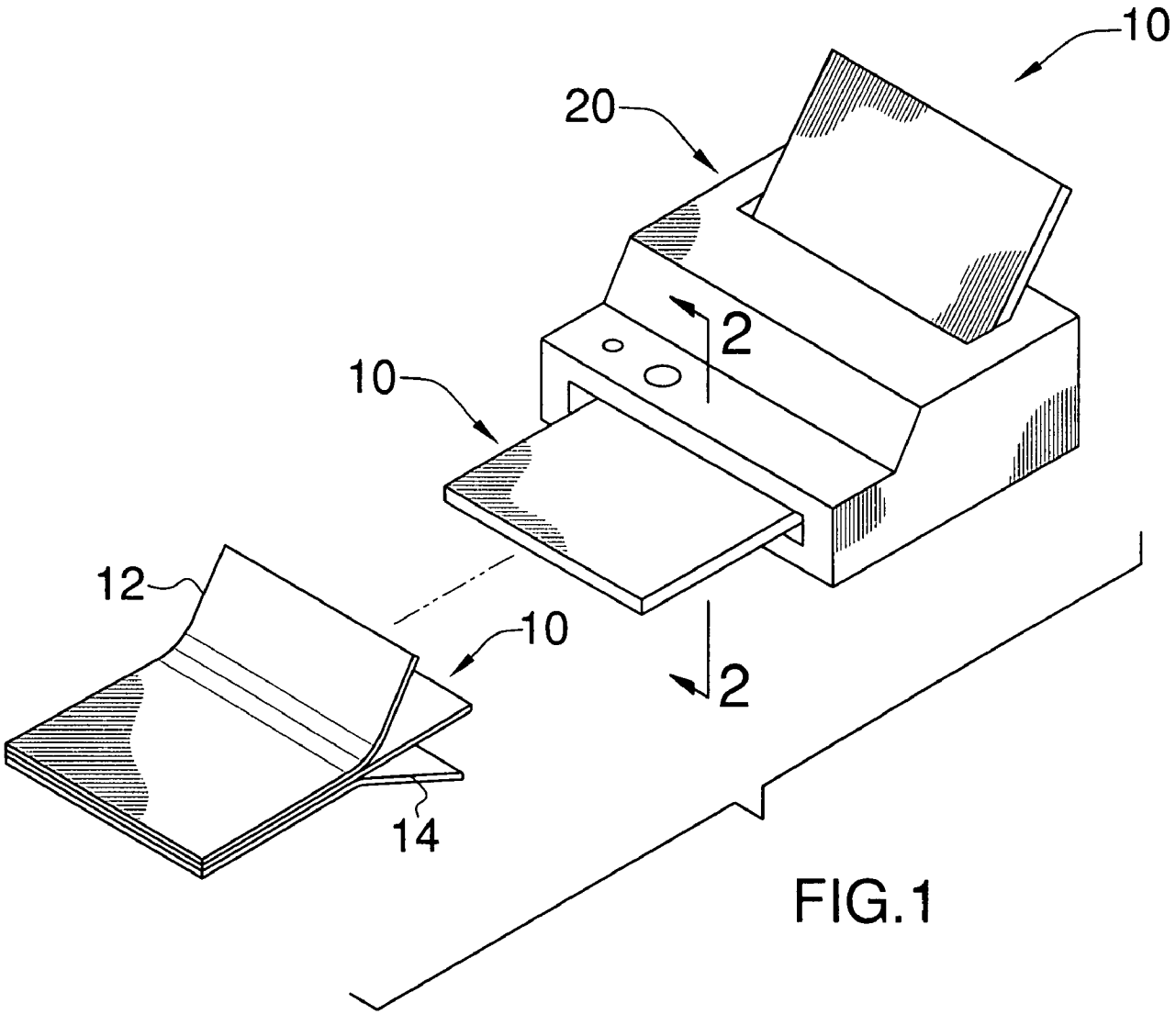
FIG. 1 is a perspective view showing the practice of the present invention conditioning method on a fax machine.

The roller conditioning sheet 10, which may also serve a cleaning function, is shown in FIG. 1 in a perspective view illustrating how the sheet 10 is fed through a fax machine 20. The roller conditioning sheet 10 may be formed of a fiberous paper material and preferably, having a higher rag content such as at least 20 weight percent, and more preferably, at least 30 weight percent.

The roller conditioning sheet 10 is impregnated with a liquid material, preferably to saturation, and then covered by an upper protection sheet 12 and a lower protection sheet 14. The protection sheets 12 and 14 prevents the liquid material contained in the roller conditioning sheet 10 from evaporating away and thus, preserves the high liquid content in the sheet 10. The protective sheets 12 and 14 must be peeled away prior to feeding the sheet 10 through an office machine.

It should be noted that, as shown in FIG. 1, the fax machine 20 is only one of many different applications that the present invention roller conditioning sheet 10 may be utilized. For instance, other frequently used office machines such as copiers, computer printers, image scanners and any other combination multi-purpose machines can also be conditioned, or be conditioned and cleaned by the present invention roller conditioning sheet 10.

It is the unique discovery of the present invention that the liquid material used to impregnate the roller conditioning sheet 10 should contain at least 30 weight percent of tri-ethylene glycol, the liquid material may also contain at least 20 weight percent of methoxy-ethanol. The liquid material may also contain at least 10 weight percent of poly-oxy-1-2-ethanediyl; and at least 7 weight percent of alpha-hydro-omega-hydroxy. A preferred range of chemical composition for the liquid material that is used to impregnate the present invention roller conditioning sheet 10 may be as follows: tri-ethylene glycol between 30 weight percent and 50 weight percent; methoxy-ethanol between 20 weight percent and 40 weight percent; poly-oxy-1-2-ethanediyl between 10 weight percent and 20 weight percent; and alpha-hydro-omega-hydroxy between 7 weight percent and 17 weight percent. A more preferred composition for the liquid material that is used to impregnate the present invention roller conditioning sheet, which may also serve a cleaning function, is as follows: tri-ethylene glycol 43 weight percent; methoxy-ethanol 30 weight percent; poly-oxy-1-2-ethanediyl 15 weight percent; and alpha-hydro-omega-hydroxy 12 weight percent.

Figure 2:
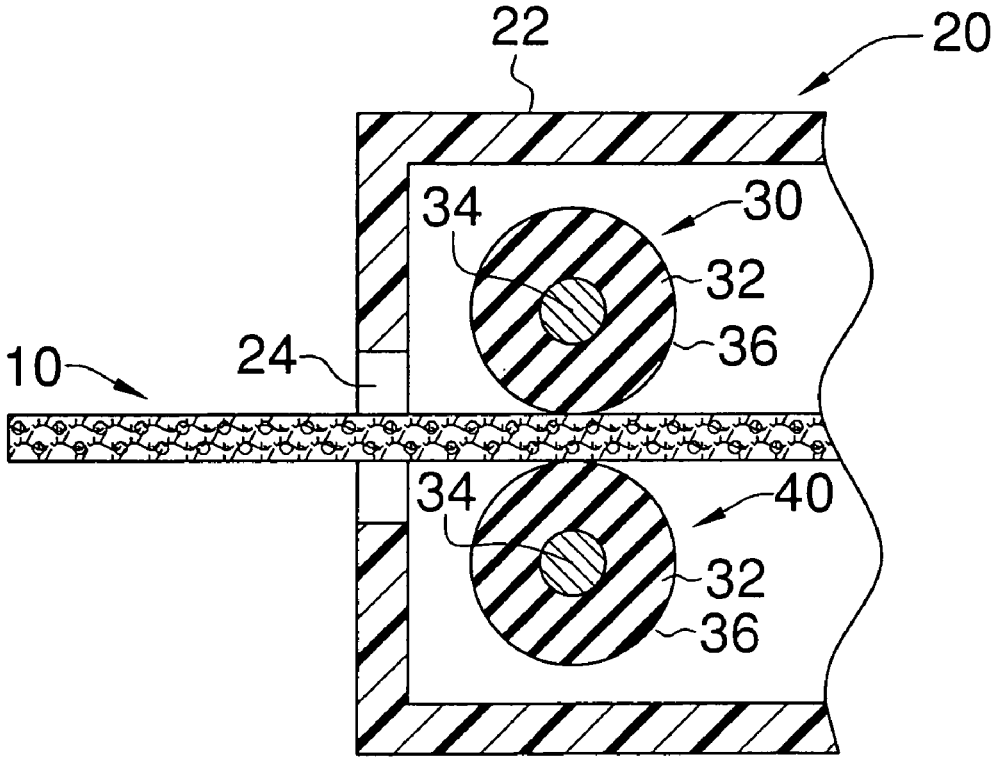
FIG. 2 is a cross-sectional view showing the present invention roller conditioning sheet being fed through a pair of roller conveyors that are covered by a rubber cover material.
Figure 3:
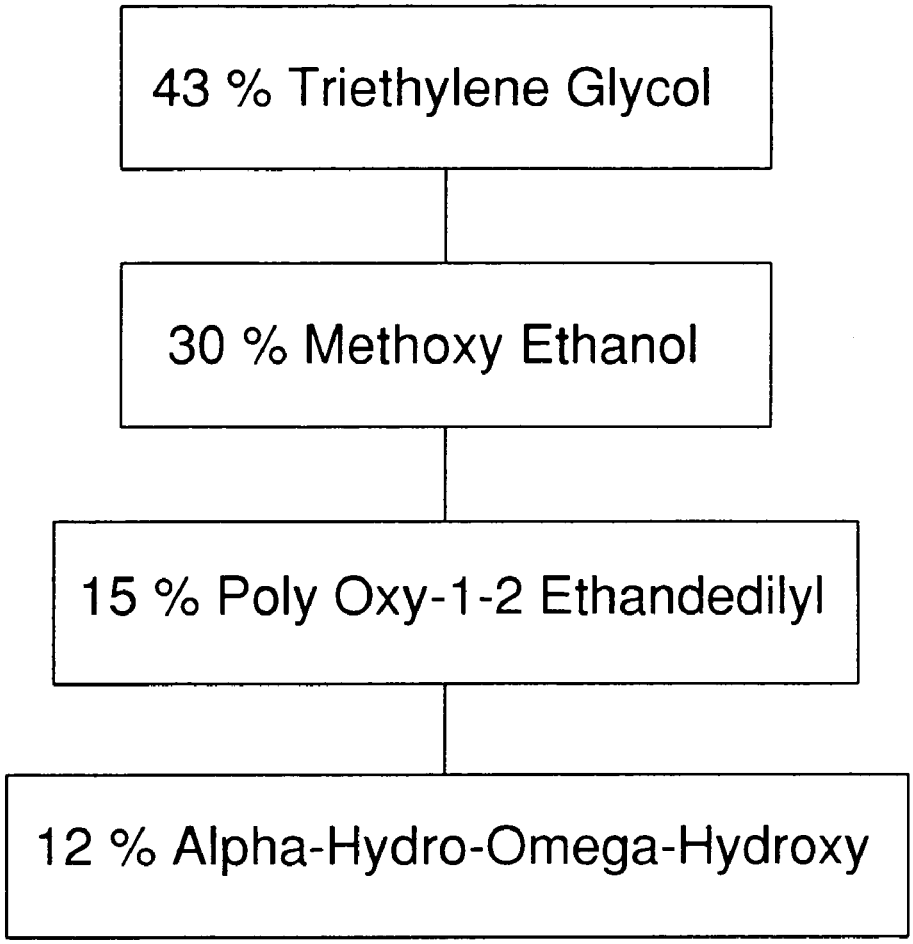
FIG. 3 is a chart showing the composition of the liquid material for impregnating the roller conditioning sheet of the present invention.

The liquid material should be compatible with the cover material used on the roller conveyor such that it will be absorbed by the outermost surface layer of the cover material after the conditioning sheet 10 is passed through the rollers 30 and 40, as shown in FIG. 2. The rollers 30,40 are formed of a cover material 32 and supported by a rigid shaft 34. The cover material 32 may be a flexible and resilient material such as, for example, natural rubber, synthetic rubber, polyurethane, polyester, polyvinyl chloride, and any other suitable polymeric materials. The rigid shaft 34 may be formed of a metal or a rigid plastic material.

As shown in FIG. 4, in the cross-sectional view illustrating a partial sectional view of a housing 22 for the fax machine 20, a roller conditioning sheet 10 is fed through the two rollers 30,40 and conveyed by the flexible, resilient cover formed by material 32 and exiting at an exit opening 24. After the rollers 30,40 are conditioned, and possibly also cleaned by the roller conditioning sheet 10, the outermost surface 36 of the cover material 32 is coated with the liquid material that is impregnated in the roller conditioning sheet 10. The liquid material is absorbed into the cover material 32 by diffusion through the outermost surface 36 and thus, conditions the cover material 32 and restores its flexibility and resiliency. The rollers 30,40 may be conditioned after a fixed number of objects have been processed through the office machine. For instance, the rollers may be conditioned after every 10,000 sheets have been fed through the fax machine 20.

The present invention further provides a method for conditioning, or for conditioning and cleaning roller conveyors in an office machine. In the method, the office machine is first switched on, the protective covers on the roller conditioning sheet are then peeled off such that the conditioning sheet impregnated with the conditioning liquid material can be fed through rollers in the office machine. After the rollers are conditioned by the conditioning sheet, the rollers may be left for drying or a dry sheet, with high rag content, may be fed through the rollers to absorb any excess liquid conditioning material from the outermost surface of the rollers.

By utilizing the present invention roller conditioning sheet and carrying out the conditioning method, an aged roller conveyor in an office machine may be rejuvenated and reconditioned to its original flexibility and resiliency and thus, functions properly for conveying objects through the rollers.

What is claimed is:

1. A roller conditioning sheet for conditioning a cover material on a roller conveyor, wherein the roller conditioning sheet is impregnated with a conditioning material comprising at least 30 weight percent tri-ethylene glycol wherein said liquid conditioning material further comprises at least 20 weight percent of methoxy-ethanol.

2. The roller conditioning sheet of claim 1, wherein said liquid conditioning material comprises between 30 weight percent and 50 weight percent of tri-ethylene glycol.

3. The roller conditioning sheet of claim 1, wherein said liquid conditioning material further comprises between 20 weight percent and 40 weight percent of methoxy-ethanol.

4. The roller conditioning sheet of claim 1, wherein said sheet comprises at least 20 weight percent rag.

5. The roller conditioning sheet of claim 4, wherein said sheet having a dimension that is similar to a xerographic copier paper.

6. A roller conditioning sheet that is impregnated with a liquid conditioning material, wherein said liquid conditioning material comprises between 30 weight percent and 50 weight percent of tri-ethylene glycol; between 20 weight percent and 40 weight percent of methoxy-ethanol; between 10 weight percent and 20 weight percent of poly-oxy-1-2-ethanediyl; and between 7 weight percent and 17 weight percent of alpha-hydro-omega-hydroxy.

7. The roller conditioning sheet of claim 6, wherein said liquid conditioning material comprises preferably between 38 weight percent and 48 weight percent of tri-ethylene glycol; between 25 weight percent and 35 weight percent of methoxy-ethanol; between 12 weight percent and 18 weight percent of poly-oxy-1-2-ethanediyl; and between 9 weight percent and 15 weight percent of alpha-hydro-omega-hydroxy.

8. The roller conditioning sheet of claim 6, wherein said liquid conditioning material comprises 43 weight percent of tri-ethylene glycol; 30 weight percent of methoxy-ethanol; 15 weight percent of poly-oxy-1-2-ethanediyl; and 12 weight percent of alpha-hydro-omega-hydroxy.

9. The roller conditioning sheet of claim 6, wherein said sheet comprises at least 20 weight percent rag.

10. The roller conditioning sheet of claim 6, wherein said sheet having a dimension of about 8½ inches by 11 inches.

11. A method for conditioning the cover material of a roller conveyor comprising the steps of:

providing a roller conditioning sheet having at least 20 weight percent rag;

impregnating the roller conditioning sheet with a liquid conditioning material that comprises at least 30 weight percent tri-ethylene glycol and at least 20 weight percent methoxy-ethanol;

switching on an office machine that has roller conveyors rotated therein; and feeding said roller conditioning sheet through said roller conveyors in the office machine.

12. The method for conditioning roller conveyors in an office machine according to claim 11, further comprising the step of feeding a dry sheet through said roller conveyors after said conditioning step.

* * * * *